US011490209B2

(12) United States Patent
Takano et al.

(10) Patent No.: US 11,490,209 B2
(45) Date of Patent: Nov. 1, 2022

(54) VIBRATION GENERATION APPARATUS

(71) Applicant: Faurecia Clarion Electronics Co., Ltd., Saitama (JP)

(72) Inventors: Yousuke Takano, Saitama (JP); Naoki Takada, Saitama (JP); Kenji Kono, Saitama (JP); Akira Mutou, Saitama (JP)

(73) Assignee: Faurecia Clarion Electronics Co., Ltd., Saitama (JP)

( * ) Notice: Subject to any disclaimer, the term of this patent is extended or adjusted under 35 U.S.C. 154(b) by 0 days.

(21) Appl. No.: 17/351,237

(22) Filed: Jun. 18, 2021

(65) Prior Publication Data

US 2021/0409870 A1 Dec. 30, 2021

(30) Foreign Application Priority Data

Jun. 30, 2020 (JP) ..... JP2020-113331

(51) Int. Cl.

| | |
|---|---|
| ***H04R 9/06*** | (2006.01) |
| ***H04R 9/04*** | (2006.01) |
| ***H04R 9/02*** | (2006.01) |

(52) U.S. Cl.

CPC ..... *H04R 9/043* (2013.01); *H04R 9/025* (2013.01); *H04R 9/06* (2013.01); *H04R 9/066* (2013.01); *H04R 2400/03* (2013.01); *H04R 2400/07* (2013.01); *H04R 2400/11* (2013.01)

(58) Field of Classification Search

CPC ..... H04R 7/045; H04R 9/025; H04R 9/043; H04R 9/06; H04R 9/066; H04R 2400/03; H04R 2400/07; H04R 2400/11

See application file for complete search history.

(56) References Cited

U.S. PATENT DOCUMENTS

| | | | | |
|---|---|---|---|---|
| 6,618,487 | B1 * | 9/2003 | Azi | H04R 5/02 381/396 |
| 10,462,560 | B2 * | 10/2019 | Timothy | H04R 9/066 |
| 2017/0150271 | A1 * | 5/2017 | Bongiovi | H04R 9/043 |
| 2018/0054679 | A1 | 2/2018 | Kono | |

FOREIGN PATENT DOCUMENTS

| | | |
|---|---|---|
| JP | 11-215593 | 8/1999 |
| JP | 6325957 B2 | 5/2016 |

* cited by examiner

*Primary Examiner* — Huyen D Le
(74) *Attorney, Agent, or Firm* — Mori & Ward, LLP

(57) ABSTRACT

A vibration generation apparatus includes a concave frame, a vibrator, and a first damper. The frame has an opening in upper portion thereof. The vibrator is housed in the frame. The first damper is connected to the vibrator and the frame and is configured to hold the vibrator such that the vibrator is able to move in an up-down direction with respect to the frame. The first damper has a predetermined thickness. The first damper is in an N-shape in a side view and includes two bent portions and has an upper end mounted on an edge of the opening and a lower end mounted on a lower edge of the vibrator.

4 Claims, 9 Drawing Sheets

VIBRATION GENERATION APPARATUS

CROSS-REFERENCE TO RELATED APPLICATIONS

The present application claims priority to Japanese Patent Application JP 2020-113331 filed in the Japan Patent Office on Jun. 30, 2020, the entire content of which is hereby incorporated by reference:

BACKGROUND OF THE INVENTION

Field of the Invention

The present invention relates to a vibration generation apparatus.

Description of the Related Art

Speakers have been known as apparatuses that convert acoustic signals into sounds (air vibrations). Such speakers are disclosed in, for example, Japanese Unexamined Patent Application Publication No. 11-215593 and other publications. FIG. 8 is a side sectional view showing a schematic configuration of a typical cone speaker.

A cone speaker 200 includes an inner yoke 201 in which a cylinder 201*b* is integrally formed on the central portion of a disc-shaped bottom 201*a*, a circular ring magnet 202 having an opening 202*a* having a larger diameter than the cylinder 201*b* of the inner yoke 201 in the central portion thereof, and a circular outer yoke 203 disposed on the ring magnet 202 in a stacked manner.

The cone speaker 200 also includes a frame 204 mounted on the outer yoke 203, a cylindrical voice coil bobbin 206 mounted to the frame 204 through a damper 205, a cone 208 mounted on one end 206*a* of the voice coil bobbin 206 and mounted to the frame 204 through an edge 207, and a dome 209 that covers the open end 206*a* of the cylindrical voice coil bobbin 206.

The cone 208 consists of bowl-shaped cone paper formed of pulp or the like. As described above, the cone 208 and dome 209 are mounted on the end 206*a* of the voice coil bobbin 206. For this reason, when acoustic signals flow through a voice coil 210 disposed on the other end of the voice coil bobbin 206, the voice coil bobbin 206 and cone 208 are influenced by a magnetic field generated by the ring magnet 202, inner yoke 201, and outer yoke 203 and thus move in the up-down direction, resulting in vibration of the cone 208 and dome 209. Thus, the acoustic signals are converted into air vibrations, such as sounds.

To convert acoustic signals into high-quality sounds, a good-quality damper needs to be used. One typical damper production method is as follows: first, woven fabric obtained by plainly weaving a fiber, or the like is impregnated with a thermosetting resin solution obtained by diluting phenol resin or the like to a predetermined concentration with a solvent using a technique, such as dipping; then, damper base fabric formed of an uncured resin is produced by volatizing the solvent; and the damper base fabric is subjected to thermocompression molding to produce a damper. The damper obtained by adding the thermosetting resin to the fiber or the like as described above is lightweight and has excellent vibration performance.

On the other hand, there are known speakers called exciters that vibrate not the cone 208 or dome 209 but another member in contact with the frame, such as a diaphragm material, and output sounds through the other member. Such speakers are disclosed in, for example, Japanese Patent No. 6325957 and the like.

FIG. 9A is a perspective view showing an example of an exciter. FIG. 9B is a side sectional view of the exciter taken along cut line IXb-IXb of FIG. 9A. An exciter 300 mainly includes a frame 301, a vibrator 302, and a damper 303.

The frame 301 is in the shape of a bottomed cylinder. As will be described later, when the vibrator 302 moves in the up-down direction through the damper 303, vibrations are transmitted to the frame 301. The frame 301 transmits the received vibrations to a diaphragm material or the like (not shown) in contact with the frame 301 so that the diaphragm or the like outputs sounds.

The vibrator 302 is mounted to an opening 301*a* of the frame 301 through the damper 303. The vibrator 302 mainly includes an outer yoke 304, a disc-shaped magnet 305, and an inner yoke 306. The outer yoke 304 is in the shape of a ceilinged cylinder having an open lower portion. The disc-shaped magnet 305 is mounted on the inner ceiling of the outer yoke 304, and the disc-shaped inner yoke 306 is mounted on a lower portion of the disc-shaped magnet 305.

The diameters of the disc-shaped magnet 305 and inner yoke 306 are smaller than the inner diameter of the cylindrical outer yoke 304. A clearance is formed between the inner surface 304*a* of the outer yoke 304 and the outer surfaces of the disc-shaped magnet 305 and inner yoke 306 facing the inner surface 304*a*. One end of a voice coil bobbin 308 is mounted on the inner bottom 301*b* of the frame 301, and the other end of the voice coil bobbin 308 on which is provided a voice coil 309 is located in the clearance.

The damper 303 is formed by performing a cut-out process on an elastic metal plate member. As shown in FIG. 9A, the damper 303 is provided with approximately S-shaped multiple legs 303*a*. A first end 303*b* of each approximately S-shaped leg 303*a* is connected to the upper surface of the opening 301*a* of the frame 301, and a second end 303*c* thereof is connected to the side circumferential surface 304*c* of the vibrator 302 (outer yoke 304). Since the legs 303*a* of the damper 303 are approximately S-shaped, the damper 303 transmits the vibrations of the vibrator 302 to the frame 301 while preventing reductions in the vibrations as much as possible In the exciter 300 shown in FIGS. 9A and 9B, the vibrator 302 including the inner yoke 306, outer yoke 304, and disc-shaped magnet 305 moves in the up-down direction with respect to the frame 301, unlike in the cone speaker 200 shown in FIG. 8. For this reason, if the damper 205 formed of the fiber or the like used in the cone speaker 200 is used as the damper of the exciter 300, the damper would have difficulty in reliably holding the vibrator 302 while maintaining smooth movement in the up-down direction of the vibrator 302. The damper 303 of the exciter 300 is formed of the metal plate member. Thus, the damper 303 is able to reliably hold the vibrator while allowing the vibrator 302, which is heavier than cone paper, to smoothly move in the up-down direction.

The exciter 300 is also able to output heavy bass, which is difficult to play back using only the cone speaker 200, without having to use a low-frequency speaker, such as a woofer.

Since the damper 303 of the exciter 300 is formed by performing the cut-out process on the elastic metal plate member, an attempt to improve the elastic performance of the damper 303 tends to lead to an increase in the plan diameter of the damper 303. Specifically, by increasing the length of the legs 303*a* of the damper 303 shown in FIG. 9A, the vibrator 302 is allowed to actively move in the up-down direction. However, increasing the length of the legs 303*a* leads to an increase in the plan diameter of the damper 303 and thus an increase in the outer diameter of the frame 301, resulting in upsizing of the exciter 300.

The present invention has been made in view of the above issue, and an object thereof is to downsize a vibration generation apparatus including a damper.

SUMMARY OF THE INVENTION

A vibration generation apparatus according to one aspect of the present invention includes a concave frame, a vibrator, and a first damper. The frame has an opening in an upper portion thereof. The vibrator is housed in the frame. The first damper is connected to the vibrator and the frame and is configured to hold the vibrator such that the vibrator is able to move in an up-down direction with respect to the frame. The first damper has a predetermined thickness and is in an N-shape in a side view. The first damper includes upper and lower two bent portions whose inner angles are changed in conjunction with each other when the vibrator moves in the up-down direction with respect to the frame, and has an upper end mounted on an edge of the opening and a lower end mounted on a lower edge of the vibrator.

In the vibration generation apparatus according to the one embodiment of the present invention, the first damper has the predetermined thickness, includes the two bent portions, and has the N-shape in a side view. Since the first damper is bent in the up-down movement direction of the vibrator, the horizontal length of the first damper from the vibrator to the frame is reduced compared to that of conventional exciters. The outer diameter of the vibration generation apparatus is smaller than that of conventional one and is downsized.

Also, even if the horizontal length of the first damper from the vibrator to the frame is reduced, the first damper is bent in the up-down movement direction of the vibrator. Thus, the first damper obtains a sufficient extension/contraction length and thus sufficient damper performance.

In the vibration generation apparatus according to the one embodiment of the present invention, the upper end of the N-shaped first damper is mounted on the edge of the opening of the frame, and the lower end thereof is mounted on the lower edge of the vibrator. For this reason, the heights of the mounting positions of the upper and lower ends of the first damper are different. When the vibrator moves in the up-down direction with respect to the frame, the inner angles of the upper and lower bent portions of the N-shaped first damper are changed in conjunction with each other. When the vibrator is lowered with respect to the frame, the inner angles of the bent portions are opened due to the difference between the heights of the mounting positions. Thus, a linear portion linking the two bent portions together is inclined in the horizontal direction, and the bent portion located on the frame side contacts the inner circumferential surface of the frame or the bent portion located on the vibrator side contacts the outer circumferential surface of the vibrator.

As a result, the vibrator moving in the up-down direction through the damper is prevented from excessively moving in the up-down direction.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENT

Figure 1A:
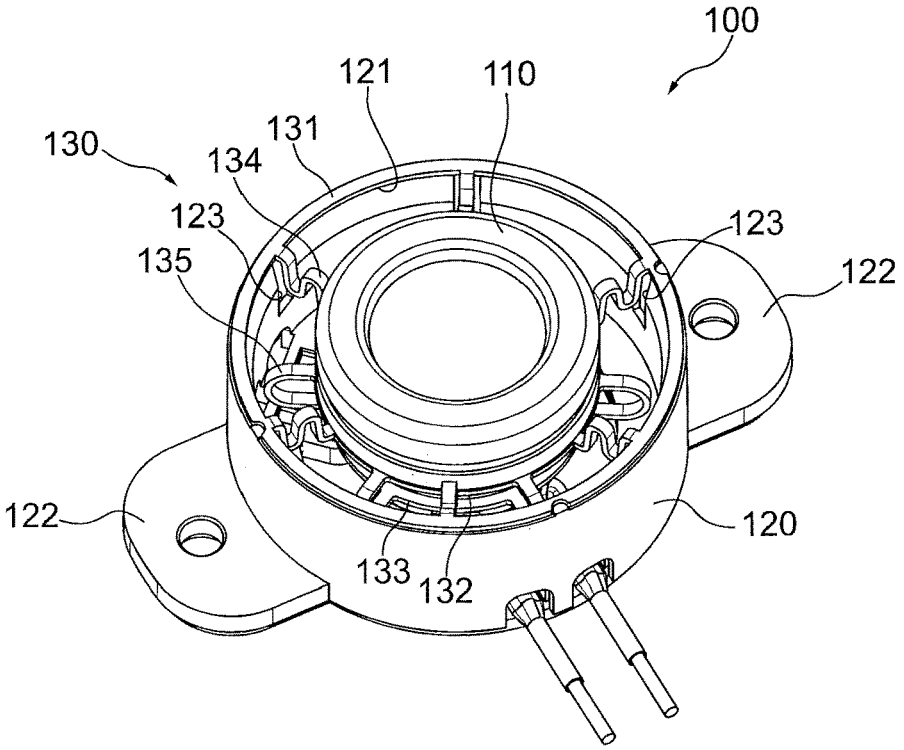
FIG. 1A is a perspective view of an exciter according to an embodiment.
Figure 1B:
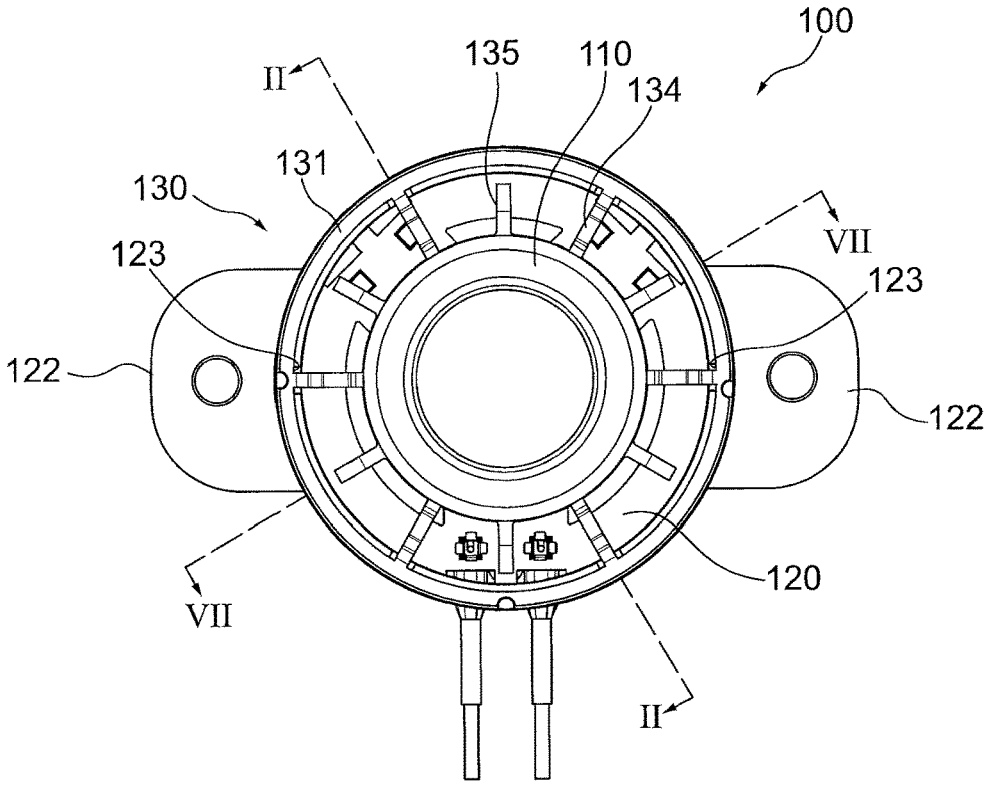
FIG. 1B is a plan view of the exciter according to the embodiment.
Figure 2:
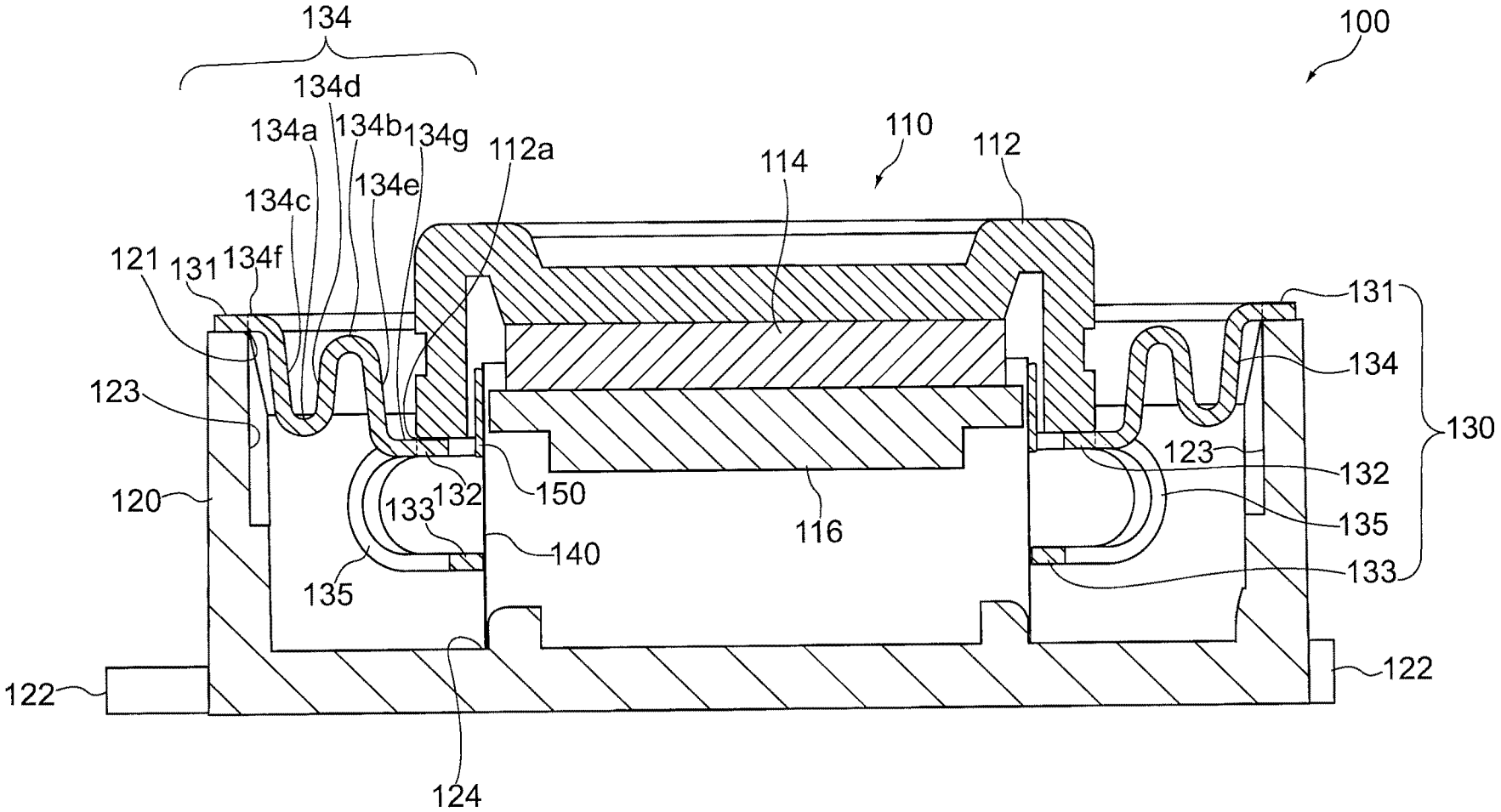
FIG. 2 is a sectional view of the exciter taken along cut line II-II shown in FIG. 1B.

Now, a vibration generation apparatus according to an embodiment of the present invention will be described in detail with reference to the drawings. FIG. 1A shows a perspective view of an exciter, which is an example of the vibration generation apparatus, and FIG. 1B shows a plan view of the exciter. FIG. 2 shows a sectional view of the exciter taken along cut line II-II of FIG. 1B and shows sections of first dampers (to be discussed later).

As shown in FIGS. 1A, 1B, and 2, an exciter (vibration generation apparatus) 100 mainly includes a vibrator 110, a frame 120, a damper 130, a voice coil bobbin 140, and a voice coil 150. The frame 120 is a bottomed, cylindrical hollow body having an opening 121 in an upper portion thereof. A pair of left and right mounting ears 122, 122 are disposed on the perimeter of the frame 120. The frame 120 transmits vibrations to a diaphragm material or the like (not shown) in contact with the bottom thereof. The mounting ears 122 aim to fix the frame 120 to the diaphragm material or the like. The frame 120 is formed of a material having excellent vibration transmission performance so that vibrations are efficiently transmitted to the diaphragm material or the like. Examples of the material having excellent vibration transmission performance include metals, resin materials, and the like.

The frame 120 houses the vibrator 110 through the damper 130. More specifically, the frame 120 holds the vibrator 110 through the damper 130 such that the vibrator 110 is able to move in the up-down direction with respect to the height position of the opening 121 of the frame 120. Vibrations generated by movements in the up-down direction of the vibrator 110 through the damper 130 are transmitted to the frame 120 through the damper 130, and the frame 120 also generates vibrations as reactions to the movements in the up-down direction of the vibrator 110. The vibrations transmitted to and generated by the frame 120 are transmitted to the diaphragm material or the like in contact with the bottom of the frame 120. The diaphragm material or the like that has received the vibrations through the bottom of the frame 120 outputs sounds or vibrations as a vibration generation member for generating vibrations or sounds.

The vibrator 110 mainly includes an outer yoke 112, a disc-shaped magnet 114, and an inner yoke 116. The outer yoke 112 is in the shape of a bottomed cylinder and has a smaller height size than the diameter. The diameter of the outer yoke 112 is smaller than that of the opening 121 of the frame 120.

The disc-shaped magnet 114 has a smaller outer diameter than the inner diameter of the outer yoke 112. The height size of the disc-shaped magnet 114 is smaller than the inner height size of the outer yoke 112. The inner yoke 116 has an inverted convex sectional shape and is formed by integrally stacking two discs having different diameters in the up-down direction. The maximum outer diameter of the inner yoke 116 is smaller than the inner diameter of the outer yoke 112. The height size of the inner yoke 116 is smaller than the inner height size of the outer yoke 112.

The disc-shaped magnet 114 is fixed to the center of the inner ceiling of the outer yoke 112. The inner yoke 116 is mounted on a lower portion of the disc-shaped magnet 114 such that the central axis thereof is coaxial with that of the disc-shaped magnet 114. A clearance for guiding the voice coil 150 and an end of the voice coil bobbin 140 is formed between the outer circumferential surfaces of the inner yoke 116 and disc-shaped magnet 114 and the inner circumferential surface of the outer yoke 112 facing these outer circumferential surfaces.

The voice coil bobbin 140 is mounted on the inside of the frame 120 and is in the shape of a cylinder. A first end of the voice coil bobbin 140 is mounted on the inner bottom 124 of the frame 120 such that the central axis of the voice coil bobbin 140 is coaxial with the central axis of the frame 120. Note that the central axis of the voice coil bobbin 140 is also coaxial with the central axis in the up-down vibration direction of the vibrator 110.

The voice coil 150 is mounted on a second end of the voice coil bobbin 140. The second end of the voice coil bobbin 140 and the voice coil 150 are located in the clearance between the outer yoke 112 and the inner yoke 116 and the like. Note that even if the vibrator 110 moves in the up-down direction with respect to the frame 120, the second end of the voice coil bobbin 140 and the voice coil 150 located in the clearance do not contact the inner circumferential surface of the outer yoke 112 or the outer circumferential surface of the inner yoke 116 or the like.

Figure 3:
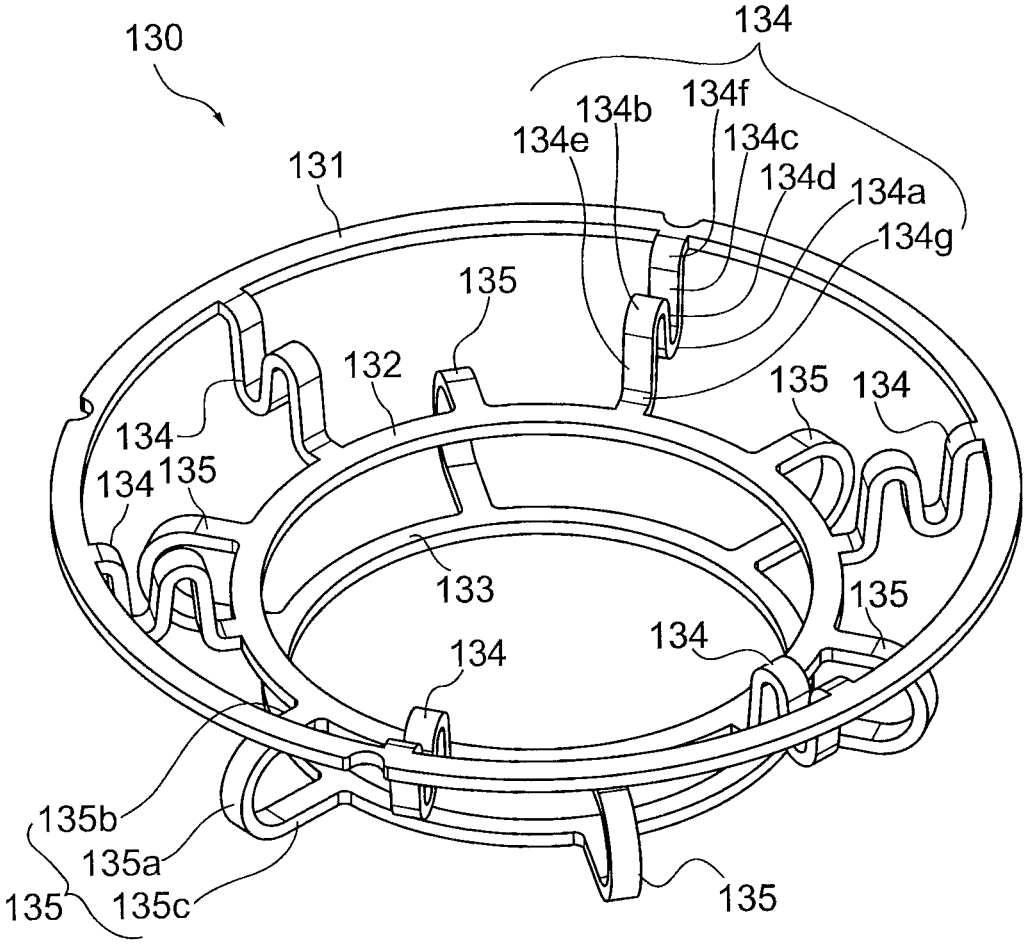
FIG. 3 is a perspective view showing a damper according to the embodiment.
Figure 4:
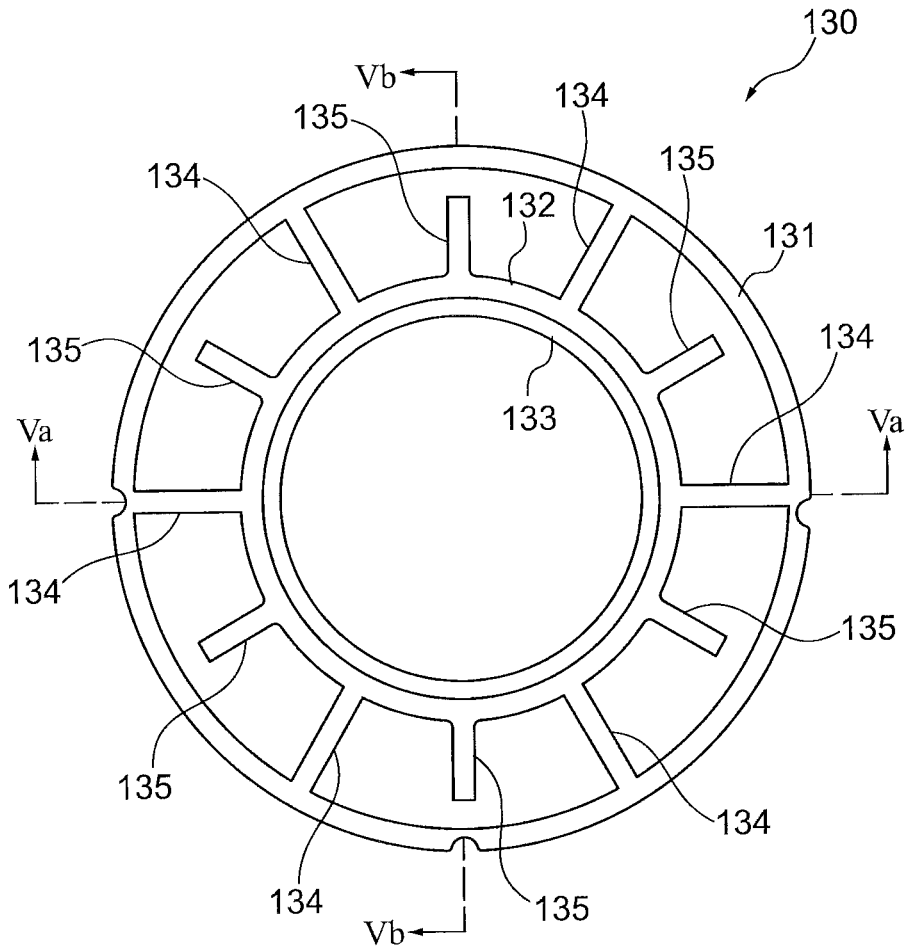
FIG. 4 is a plan view showing the damper according to the embodiment.
Figure 5A:
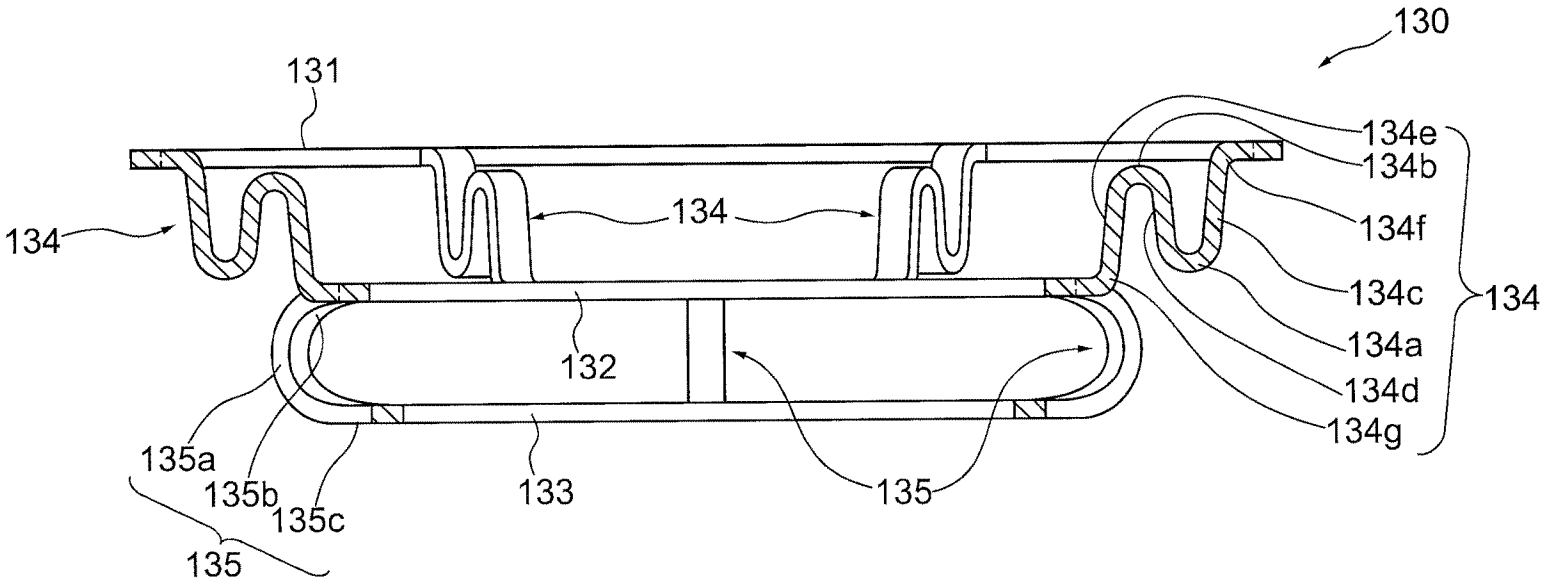
FIG. 5A is a sectional view of the damper taken along cut line Va-Va shown in FIG. 4.
Figure 5B:
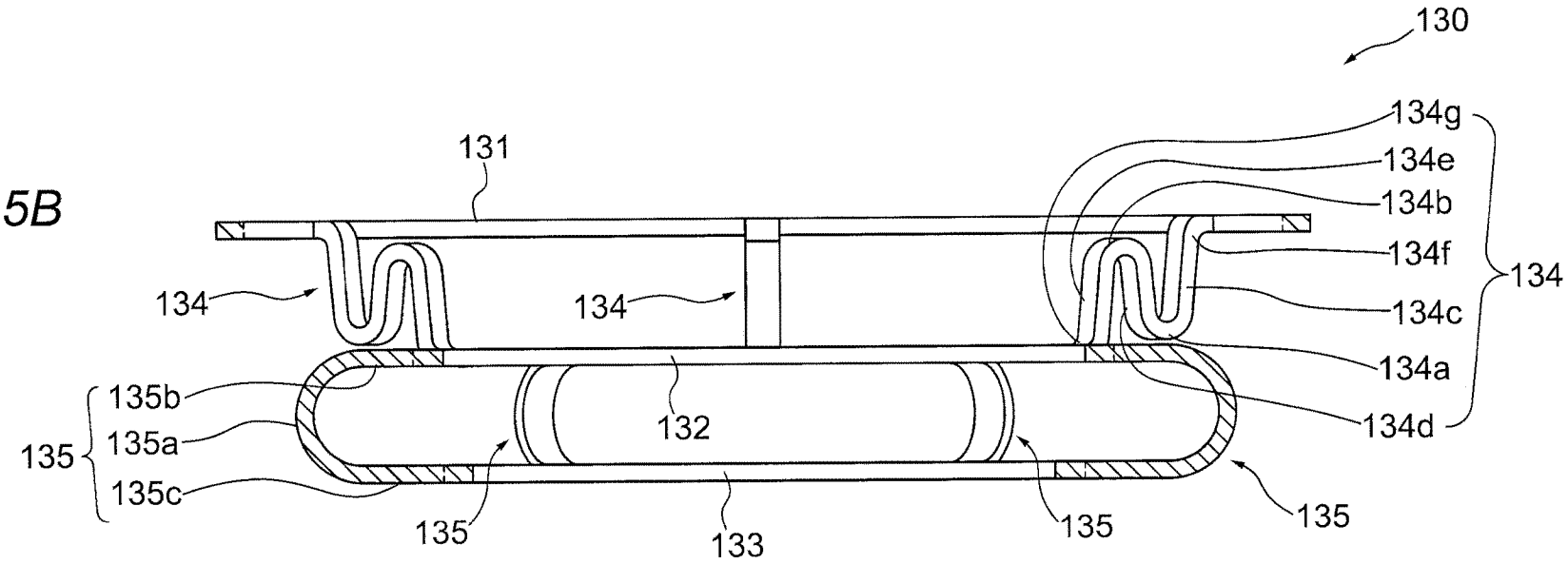
FIG. 5B is a sectional view of the damper taken along cut line Vb-Vb shown in FIG. 4.

FIG. 3 is a perspective view showing the damper 130. FIG. 4 is a plan view showing the damper 130. FIG. 5A is a sectional view taken along cut line Va-Va of FIG. 4. FIG. 5B is a sectional view taken along cut line Vb-Vb of FIG. 4.

As shown in FIGS. 3, 4, 5A, and 5B, the damper 130 includes a first circular portion 131, a second circular portion 132, a third circular portion 133, six first dampers 134, and six second dampers 135, and these components are integrally formed. The damper 130 is formed of an elastic material having strength that allows the damper 130 to hold the vibrator 110 with respect to the frame 120 and voice coil bobbin 140. For example, the damper 130 may be formed of an elastic metal, a resin material, or other materials The damper 130 according to the embodiment is formed of a resin material, such as plastic.

The first circular portion 131 is in the shape of a circle having a diameter corresponding to the diameter of the opening 121 of the frame 120. The second circular portion 132 is in the shape of a circle having a diameter corresponding to the diameter of the lower outer periphery 112*a* of the outer yoke 112. The third circular portion 133 is in the shape of a circle having a diameter that allows the inner circumferential surface of the third circular portion 133 to contact the outer circumferential surface of the voice coil bobbin 140.

The diameter of the second circular portion 132 is smaller than that of the first circular portion 131. The reason is that the diameter of the outer periphery 112*a* of the outer yoke 112 is smaller than that of the opening 121 of the frame 120. The diameter of the third circular portion 133 is slightly smaller than that of the second circular portion 132. The reason is that the diameter of the voice coil bobbin 140 on which the third circular portion 133 is mounted is slightly smaller than that of the outer periphery 112*a* of the outer yoke 112 on which the second circular portion 132 is mounted. As shown in FIGS. 3, 4, 5A, and 5B, the first circular portion 131, second circular portion 132, and third circular portion 133 are connected through the six first dampers 134 and six second dampers 135 so as to be disposed at predetermined intervals in the up-down direction on the same central axis.

Each second damper 135 mainly includes one bent portion 135*a* and two linear portions 135*b* and 135*c*, has a predetermined thickness, and is in the shape of lateral U in a side view. Each U-shaped second damper 135 has a first end connected to the outer side surface of the second circular portion 132 and a second end connected to the outer side surface of the third circular portion 133. That is, the second dampers 135 are formed integrally with the second circular portion 132 and third circular portion 133.

The six second dampers 135 are disposed on the second circular portion 132 and third circular portion 133. As shown in FIGS. 3 and 4, the multiple second dampers 135 are discretely disposed so as to be equally distanced from the central axes of the second circular portion 132 and third circular portion 133 and so as to be equally distanced from the adjacent other second dampers 135. More specifically, the multiple second dampers 135 are disposed at equal distances in the direction of 2 o'clock (the direction of 60° clockwise from the upward direction of FIG. 4), the direction of 4 o'clock (the direction of 120°), the direction of 6 o'clock (the direction of 180°), the direction of 8 o'clock (the direction of 240°), the direction of 10 o'clock (the direction of 300°), and the direction of 12 o'clock (the direction of 360° (0°)) from the centers of the second circular portion 132 and third circular portion 133.

The second circular portion 132 and third circular portion 133 are mounted on the vibrator 110 and voice coil bobbin 140 such that the central axis in the up-down vibration direction of the vibrator 110, the central axis of the voice coil bobbin 140, and the central axes of the second circular portion 132 and third circular portion 133 are coaxial.

The inner angle of the bent portion 135*a* of each second damper 135 is flexibly changed in accordance with changes in the distance in the up-down direction between the second circular portion 132 and third circular portion 133 made when the vibrator 110 moves in the up-down direction with respect to the frame 120. Specifically, the angle of the bent portion 135*a* between the linear portions 135*b* and 135*c* is changed, and the two linear portions 135*b* and 135*c* are slightly distorted. Thus, when the second circular portion 132 and third circular portion 133 excessively move away from each other, the second dampers 135 exert their elasticity in the direction in which both components approach each other. Also, when the second circular portion 132 and third circular portion 133 excessively approach each other, the second dampers 135 exert their elasticity in the direction in which both components move away from each other. When the vibrator 110 is stationary with respect to the frame 120, the second dampers 135 keep constant the distance between the second circular portion 132 and third circular portion 133.

Each first damper 134 mainly includes two main bent portions 134*a* and 134*b*, three linear portions 134*c*, 134*d*, and 134*e*, an upper mounting bent portion 134*f*, and a lower mounting bent portion 134*g*. Each first damper 134 has a predetermined thickness and is in the shape of N or inverted N in a side view. As shown in FIG. 2, each N-shaped first damper 134 has an upper end connected to the inner side surface of the first circular portion 131 and a lower end connected to the outer side surface of the second circular portion 132. That is, the first dampers 134 are integrally formed with the first circular portion 131 and second circular portion 132.

The upper end of each N-shaped first damper 134 is connected to the inner side surface of the first circular portion 131. Specifically, as shown in FIGS. 2, 4, 5A, and 5B, the upper end of the linear portion 134*c* is bent from an approximately vertical direction to an approximately horizontal direction and is connected to the inner side surface of the first circular portion 131. The bent upper end corresponds to the above-mentioned upper mounting bent portion 134*f*. The lower end of each N-shaped first damper 134 is connected to the outer side surface of the second circular portion 132. Specifically, as shown in FIGS. 2, 4, 5A, and 5B, the lower end of the linear portion 134*e* is bent from an approximately vertical direction to an approximately horizontal direction and is connected to the inner circumferential surface of the second circular portion 132. The bent lower end corresponds to the above-mentioned lower mounting bent portion 134*g*.

Since the connections of the upper end (upper mounting bent portion 134*f*) of each N-shaped first damper 134 and first circular portion 131 and the lower end (lower mounting bent portion 134*g*) thereof and second circular portion 132, respectively, the height position of the connection of the upper end (upper mounting bent portion 134*f*) and the first circular portion 131 becomes higher than that of the connection of the lower end (lower mounting bent portion 134*g*) and the second circular portion 132. Thus, when the vibrator 110 is stationary, the damper 130 holds the vibrator 110 such that the middle position of the height of the vibrator 110 becomes the height position of the opening 121 of the frame 120.

The six first dampers 134 are disposed so as to link together the inner side surface of the first circular portion 131 and the outer side surface of the second circular portion 132. As shown in FIGS. 3 and 4, the multiple first dampers 134 are discretely disposed so as to be equally distanced from the central axes of the first circular portion 131 and second circular portion 132 and so as to be equally distanced from the adjacent other first dampers 134. More specifically, the multiple first dampers 134 are disposed at equal intervals in the direction of 1 o'clock (the direction of 30° clockwise from the upward direction of FIG. 4), the direction of 3 o'clock (the direction of 90°), the direction of 5 o'clock (the direction of 150°), the direction of 7 o'clock (the direction of 210°), the direction of 9 o'clock (the direction of 270°), and the direction of 11 o'clock (the direction of 330°) from the centers of the first circular portion 131 and second circular portion 132.

The first circular portion 131 and second circular portion 132 are mounted on the frame 120 and vibrator 110 such that the central axis in the up-down vibration direction of the vibrator 110, the central axis of the voice coil bobbin 140, and the central axes of the first circular portion 131 and second circular portion 132 are coaxial.

The inner angles of the upper mounting bent portion 134*f*, the lower mounting bent portion 134*g*, and the two main bent portions 134*a* and 134*b* of each first damper 134 are flexibly changed in conjunction with each other in accordance with changes in the distance in the up-down direction between the first circular portion 131 and second circular portion 132 made when the vibrator 110 moves in the up-down direction with respect to the frame 120. The three linear portions 134*c*, 134*d*, and 134*e* are also slightly distorted in accordance with changes in the inner angles of the main bent portions 134*a* and 134*b* and the other bent portions.

Thus, when the first circular portion 131 and second circular portion 132 excessively move away from each other, the first dampers 134 exert their elasticity in the direction in which both components approach each other. Also, when the first circular portion 131 and second circular portion 132 excessively approach each other, the first dampers exert their elasticity in the direction in which both components move away from each other. When the vibrator 110 is stationary with respect to the frame 120, the first dampers 134 keep constant the distance between the first circular portion 131 and second circular portion 132.

The first circular portion 131 of the damper 130 is fixed to the frame 120 such that the upper surface of the periphery of the opening 121 of the frame 120 is in contact with the bottom of the first circular portion 131. The second circular portion 132 of the damper 130 is fixed to the vibrator 110 such that the upper surface of the second circular portion 132 is in contact with the lower surface of the outer periphery 112*a* of the outer yoke 112. The third circular portion 133 of the damper 130 is fixed to the voice coil bobbin 140 such that the inner circumferential surface of the third circular portion 133 is in contact with the outer circumferential surface of the voice coil bobbin 140.

Next, vibrations in the up-down direction of the vibrator 110 with respect to the frame 120 will be described. When acoustic signals are inputted to the voice coil 150, Lorentz force is generated by a magnetic field generated in the clearance between the outer yoke 112 and inner yoke 116 by the disc-shaped magnet 114 and a current flowing through the voice coil 150 located in this clearance. Due to the Lorentz force, the vibrator 110 held by the damper 130 moves in the up-down direction with respect to the frame 120 and voice coil bobbin 140, that is, the vibrator 110 reciprocates in the extending direction of the voice coil bobbin 140.

Figure 6A:
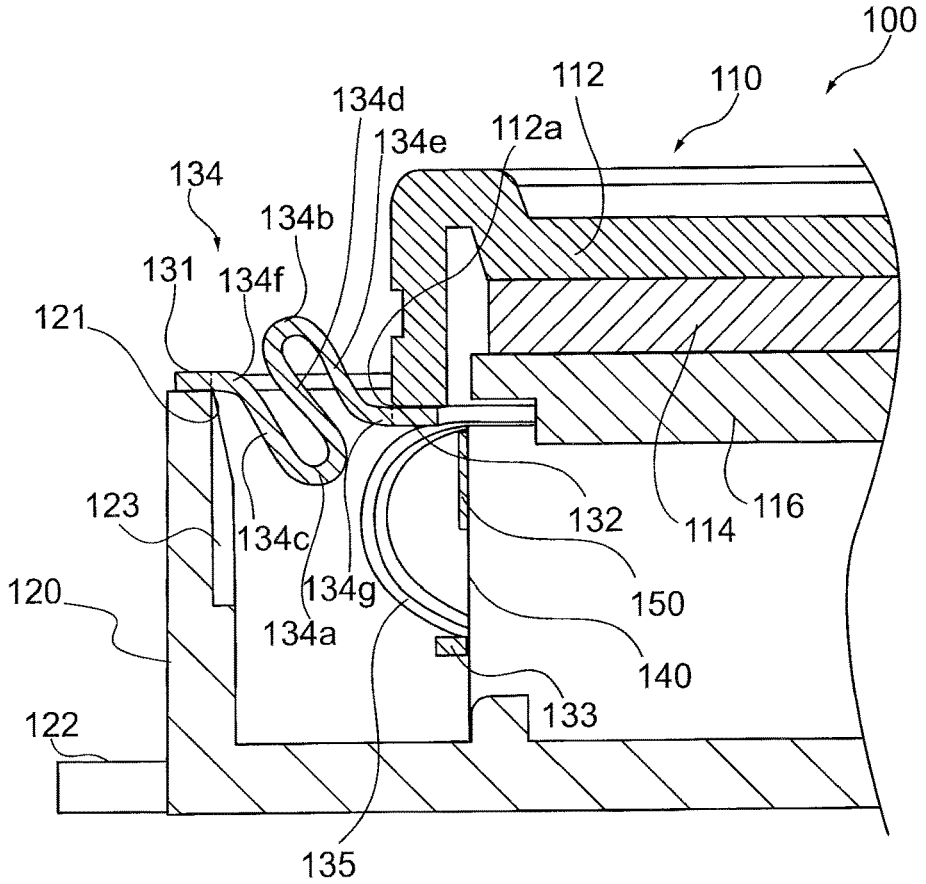
FIG. 6A is a partial sectional view of the exciter showing a state in which a vibrator is raised with respect to a frame.
Figure 6B:
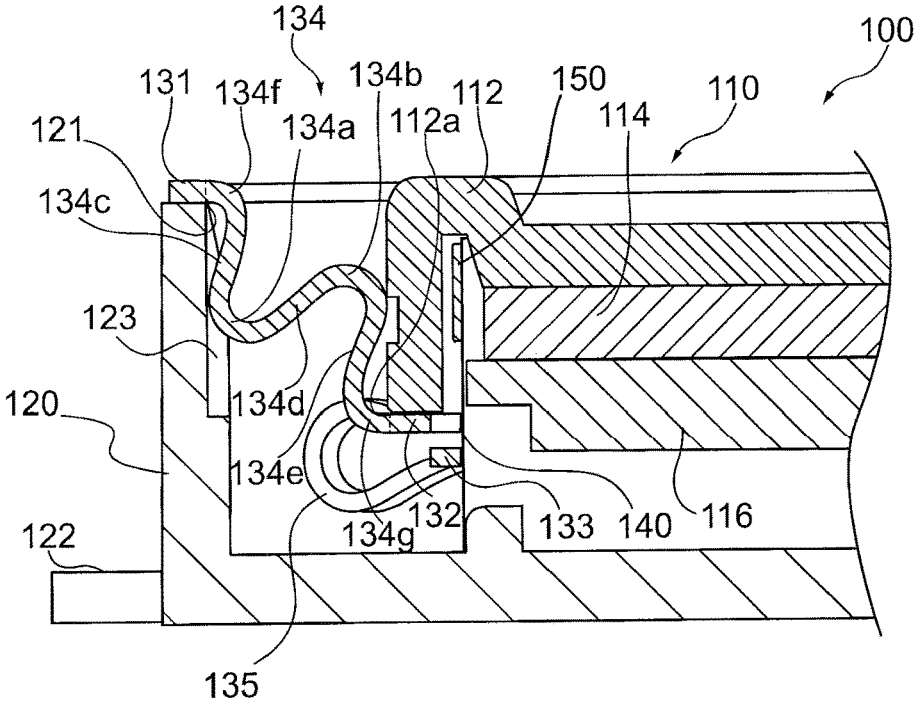
FIG. 6B is a partial sectional view of the exciter showing a state in which the vibrator is lowered with respect to the frame.

FIG. 6A is a partial sectional view of the exciter 100 showing a state in which the vibrator 110 is raised with respect to the frame 120. FIG. 6B is a partial sectional view of the exciter 100 showing a state in which the vibrator 110 is lowered with respect to the frame 120. FIG. 2 is a drawing showing a state in which the vibrator 110 is stationary with respect to the frame 120, or the moment when the vibrator 110 passes through the stationary position of the vibrator 110 during vibrations in the up-down direction with respect to the frame 120.

As shown in FIG. 6A, when the vibrator 110 is raised with respect to the frame 120, the difference between the height position of the opening 121 of the frame 120 and the height position of the lower surface of the outer edge of the outer yoke 112 is reduced. At this time, as shown in FIG. 6A, the inner angles of the two main bent portions 134*a* and 134*b* are narrowed, and the three linear portions 134*c*, 134*d*, and 134*e* are inclined obliquely and become approximately parallel with each other as a positional relationship. In this case, the main bent portion 134*a* moves toward the outer yoke 112, and the main bent portion 134*b* moves toward the frame 120. Thus, as shown in FIG. 6A, the sectional shape of the first damper 134 is changed to an approximate S-shape.

On the other hand, as shown in FIG. 6B, when the vibrator 110 is lowered with respect to the frame 120, the difference between the height position of the opening 121 of the frame 120 and the height position of the lower surface of the outer periphery 112*a* of the outer yoke 112 is increased. At this time, as shown in FIG. 6B, the inner angles of the two main bent portions 134*a* and 134*b* are widened, and the three linear portions 134*c*, 134*d*, and 134*e* are oriented in different directions using the main bent portions 134*a* and 134*b* as support points, as a positional relationship.

Specifically, the linear portions 134*c*, 134*d*, and 134*e* form V-shaped open legs with respect to the main bent portions 134*a* and 134*b*. That is, the inner angles formed by the linear portions 134*c*, 134*d*, and 134*e* are opened and thus the linear portion 134*d* linking together the main bent portion 134*a* and main bent portion 134*b* is inclined in the horizontal direction compared to that in FIG. 6A. As the linear portion 134*d* is inclined, the main bent portion 134*a* moves toward the inner circumferential surface of the frame 120 and the main bent portion 134*b* moves toward the outer circumferential surface of the outer yoke 112. Thus, even if the vibrator 110 is greatly lowered respect to the frame 120, the main bent portion 134*a* contacts the inner circumferential surface of the frame 120 or the main bent portion 134*b* contacts the outer circumferential surface of the outer yoke 112, preventing the vibrator 110 from being excessively lowered in the frame 120.

As described above, the end of the voice coil bobbin 140 and the voice coil 150 are located in the clearance between the outer yoke 112 of the vibrator 110 and the inner yoke 116 and other component thereof. For this reason, when the vibrator 110 is excessively lowered with respect to the frame 120, the voice coil 150 and the end of the voice coil bobbin 140 may hit the ceiling surface of the outer yoke 112, or the like. However, when the vibrator 110 is greatly lowered in the frame 120, the main bent portion 134*a* contacts the inner circumferential surface of the frame 120 or the main bent portion 134*b* contacts the outer circumferential surface of the outer yoke 112. Thus, the voice coil 150 and the end of voice coil bobbin 140 are prevented from hitting the ceiling surface of the outer yoke 112, or the like.

With respect to the first dampers 134, it is preferred to be previously subjected to a surface coarsening process, such as a satin process or emboss process, on portions of the main bent portions 134*a* and 134*b* that contact the inner circumferential surface of the frame 120 or the outer circumferential surface of the outer yoke 112. Thus, when the main bent portion 134*a* or 134*b* contacts the inner circumferential surface of the frame 120 or the outer circumferential surface of the outer yoke 112, the friction of the main bent portion 134*a* or 134*b* on the contact surface of the frame 120 or the outer yoke 112 is increased, preventing the contacting main bent portion 134*a* or 134*b* from being easily displaced from the contact surface of the frame 120 or the outer yoke 112 Also, the main bent portions 134*a* and 134*b* more effectively serve as stoppers.

Also, as shown in FIGS. 1A, 1B, 2, 6A, and 6B, grooves 123 having a lateral width corresponding to the predetermined thickness of the first dampers 134 and extending in the up-down direction are disposed on portions of the inner circumferential surface of the frame 120 that contact the main bent portions 134*a*. When the main bent portions 134*a* move toward the inner circumferential surface of the frame 120 as the vibrator 110 moves in the up-down direction, they are guided by the grooves 123 and contact the inner surfaces of the grooves, which are parts of the inner circumferential surface of the frame 120. Thus, the main bent portions 134*a* are prevented from being displaced in the circumferential direction of the inner circumferential surface of the frame 120. Thus, the main bent portions 134*a* more effectively serve as stoppers.

The first dampers 134 have the predetermined thickness, are in the shape of N (or inverted N) in a side view, and serve as dampers by changing the inner angles of the main bent portions 134*a* and 134*b*. While conventional dampers cause a vibrator to move in the up-down direction while distorting legs extending in the horizontal direction, the damper 130 causes the vibrator 110 to move in the up-down direction with respect to the frame 120 by changing the angle of the arm structure bent in the up-down direction. This structure of the damper 130 eliminates the need to increase the outer diameter of the damper in order to cause to vibrator to move in the up-down direction, unlike in conventional exciters. That is, in the exciter 100, the horizontal length of the first dampers 134 from the vibrator 110 to the frame 120 and thus the outer diameter of the damper 130 are smaller than those of conventional exciters. This facilitates downsizing of the exciter 100 compared to conventional exciters.

Although the horizontal length of the first dampers 134 from the vibrator 110 to the frame 120 is smaller than those of conventional dampers, the first dampers 134 have a sufficient extension/contraction length and thus sufficient damper performance. This is because the damper 130 consists of the arm structure bent in the vertical direction (in the up-down direction).

Also, the first dampers 134 are discretely disposed so as to be equally distanced from the central axes of the first circular portion 131 and second circular portion 132, that is, the central axis in the up-down vibration direction of the vibrator 110 and so as to extend in the radial direction of the vibrator 110. The first dampers 134 are also disposed on the first circular portion 131 and second circular portion 132 so as to be equally distanced from the adjacent other first dampers 134. This allows the multiple first dampers 134 to hold the vibrator 110 in good balance and to cause the vibrator 110 to smoothly move in the up-down direction while keeping the vibrator 110 horizontal.

The second dampers 135 are disposed on the second circular portion 132 and third circular portion 133, and each second damper 135 has the predetermined thickness and is in the shape of lateral U in a side view. As described above, the second dampers 135 are discretely disposed so as to be equally distanced from the central axes of the second circular portion 132 and third circular portion 133 and so as to be equally distanced from the adjacent other second dampers 135. The second circular portion 132 and third circular portion 133 are mounted on the vibrator 110 and voice coil bobbin 140 such that the central axis in the up-down vibration direction of the vibrator 110, the central axis of the voice coil bobbin 140, and the central axes of the second circular portion 132 and third circular portion 133 are coaxial. This allows the multiple second dampers 135 to hold the vibrator 110 with respect to the voice coil bobbin 140 (frame 120) in good balance and to cause the vibrator 110 to smoothly and effectively move in the up-down direction while keeping the vibrator 110 horizontal.

The first dampers 134 and second dampers 135 are mounted on angle positions different by 30° in a plan view from the centers of the circular portions 131, 132, and 133. Thus, even if the first dampers 134 or second dampers 135 are changed in shape due to a vibration in the up-down direction of the vibrator 110 with respect to the frame 120, the first dampers 134 do not contact the second dampers 135 and therefore the damper functions of the dampers 134 and 135 are not directly impaired.

As described above, the vibrator 110 is held by the frame 120 through the two types of elastic members, the first dampers 134 and second dampers 135. Thus, the vibrator 110 smoothly moves in the up-down direction while being stably kept horizontal. Also, for example, even if the orientation of the exciter 100 is changed to portrait by rotating the exciter 100 by 90° and thus the vibrator 110 advances and retreats horizontally, the vibrator 110 smoothly advances and retreats while being stably kept vertical.

Figure 7:
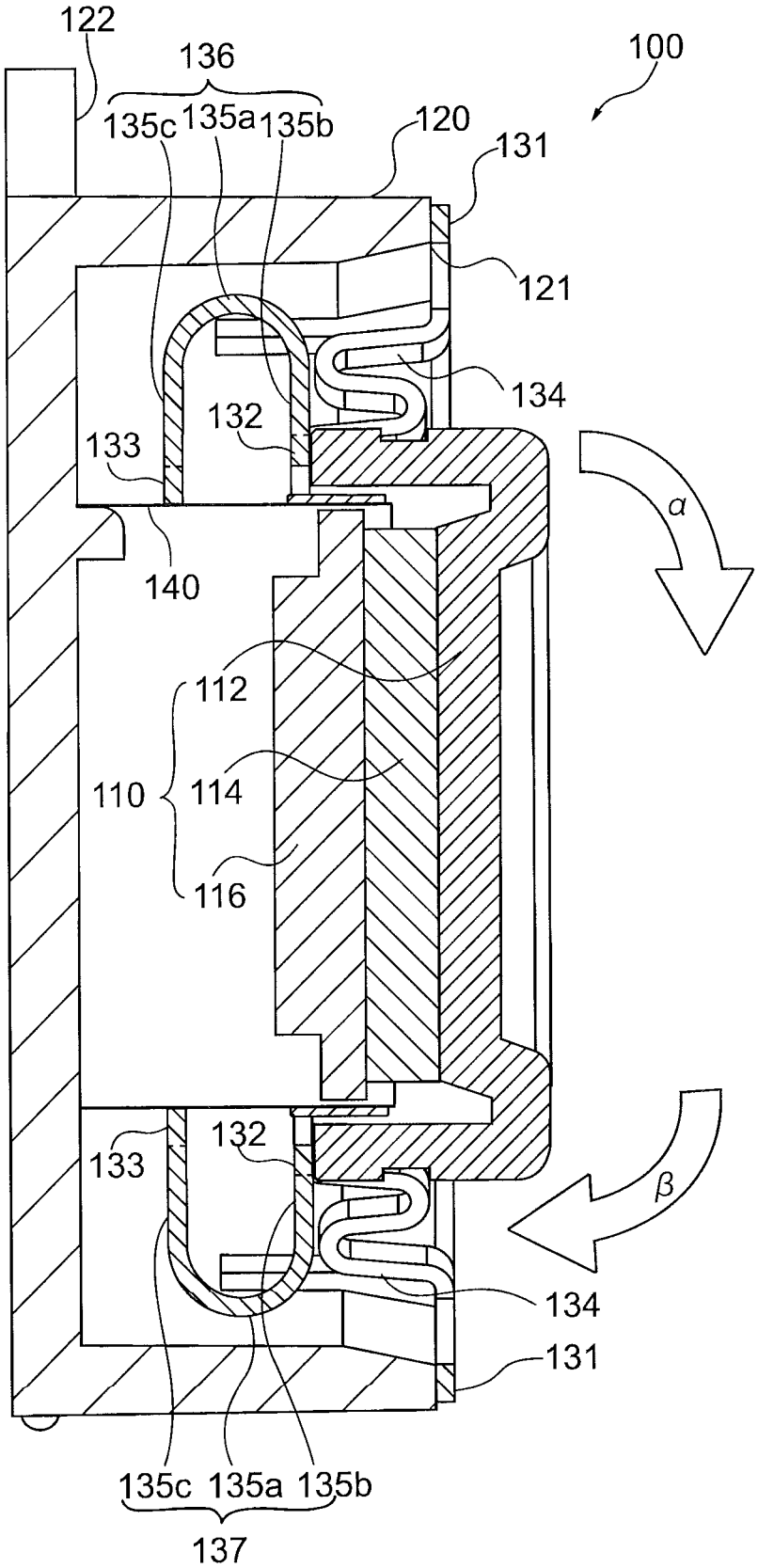
FIG. 7 is a drawing showing a state in which a sectional view of the exciter taken along cut line VII-VII shown in FIG. 1B is portrait oriented by rotation by 90°.
Figure 8:
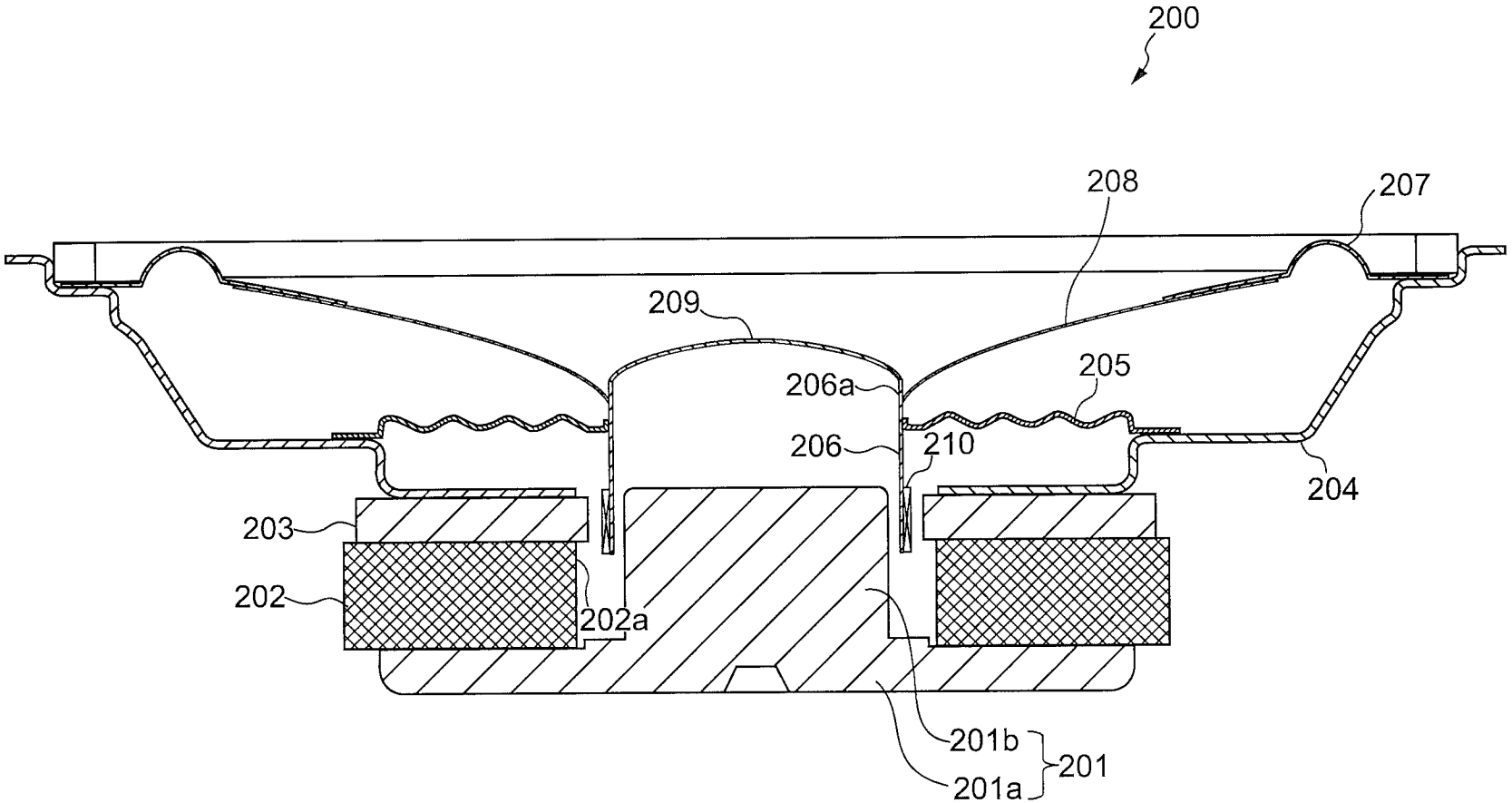
RELATED ART FIG.8
FIG. 8 is a side sectional view showing a schematic configuration of a typical cone speaker.
Figure 9A:
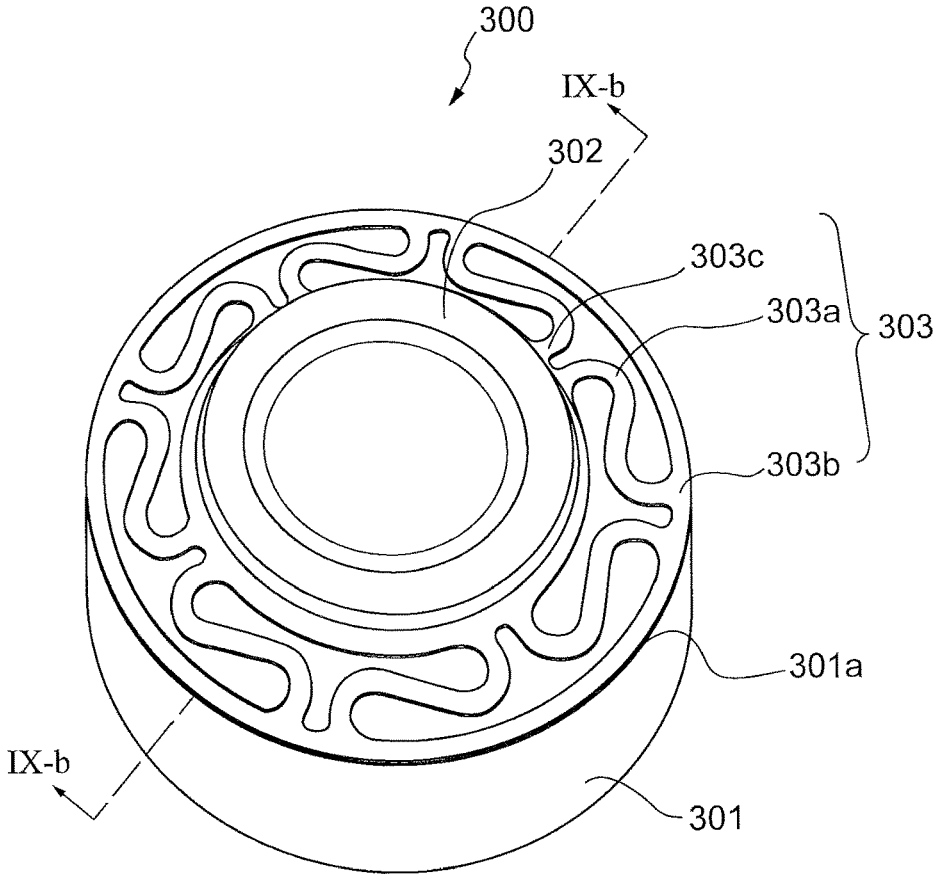
RELATED ART FIG.9A
FIG. 9A is a perspective view showing the configuration of a typical exciter.
Figure 9B:
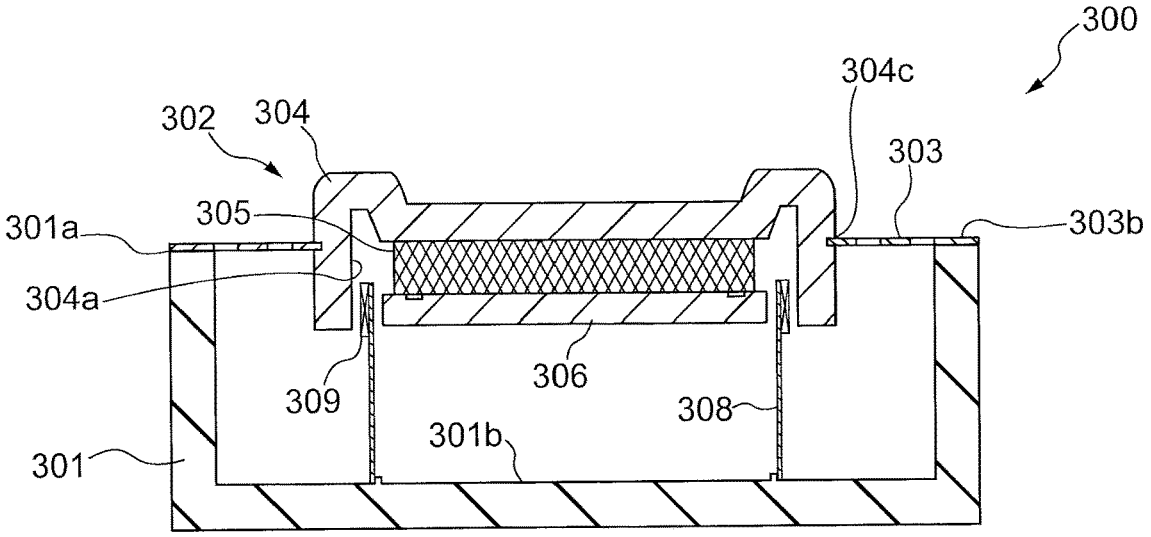
RELATED ART FIG.9B
FIG. 9B is a side sectional view of the exciter taken along cut line IXb-IXb in FIG. 9A.

FIG. 7 is a drawing showing a state in which a sectional view of the exciter taken along cut line VII-VII in FIG. 1B is portrait oriented by rotation by 90°. FIG. 7 shows a sectional view of the second dampers 135.

In the exciter 100 shown in FIG. 7, the vibrator 110 advances and retreats horizontally when acoustic signals are inputted to the voice coil 150. In a state in which no signal is being inputted to the voice coil 150, the vibrator 110 is held by the frame 120 and the voice coil bobbin 140 through the first dampers 134 and second dampers 136, 137 (135). The first dampers 134 and second dampers 136, 137 (135) are members having elasticity that allows the vibrator 110 to advance and retreat. For this reason, an upper portion of the vibrator 110 may be inclined compared to a lower portion thereof. Specifically, there may occur a so-called "axis deviation phenomenon," in which a front-upper portion of the vibrator 110 falls forward compared to a front-lower portion thereof, as shown by an arrow α.

However, as described above, the first dampers 134 keep constant the distance between the first circular portion 131 and second circular portion 132, and the second dampers 136, 137 (135) keep constant the distance between the second circular portion 132 and third circular portion 133. In particular, the second damper 136 (135) disposed on the upper side of the second circular portion 132 pulls back the upper portion of the vibrator 110 that tends to fall forward from the opening 121 of the frame 120 (as shown by the arrow α in FIG. 7), toward the voice coil bobbin 140. Also, the second damper 137 (135) disposed on the lower side of the second circular portion 132 restores the lower portion of the vibrator 110 that tends to be inclined toward the voice coil bobbin 140 in accordance with movement of the upper portion of the vibrator 110 (as shown by an arrow β in FIG. 7), to its original position. As seen above, the second dampers 136, 137 (135) hold the vibrator 110 from the upper and lower positions and corrects changes in the posture of the vibrator 110. Thus, even if the exciter 100 is disposed in portrait orientation, the vibrator 110 smoothly advances and retreats without inclination.

The damper 130 is formed of a resin material, such as plastic. As shown in FIGS. 3, 4, 5A and 5B, the damper 130 is formed by integrally mounting the six first dampers 134 and six second dampers 135 on the three circular portions 131, 132, and 133. Use of a resin material allows for relatively easily forming even such a complicated structure and reducing the forming load and cost compared to use of a metal material.

The first dampers 134 and second dampers 135 of the damper 130 are discretely disposed on the circular portions 131, 132, and 133 at predetermined intervals. Thus, sufficient spaces are secured between the adjacent first dampers 134 or second dampers 135, and heat in the frame 120 that can be generated by movement in the up-down direction (or advance/retreat) of the vibrator 110 is effectively radiated out of the frame 120 through these spaces.

The exciter 100, which is an example of the vibration generation apparatus according to the one embodiment of the present invention, has been described in detail with reference to the drawings. However, the vibration generation apparatus according to the present invention is not limited to the configuration of the exciter 100 described in the embodiment. For example, while, in the exciter 100 according to the embodiment, the six first dampers 134 and six second dampers 135 are disposed on the circular portions 131, 132, and 133, the number of first dampers 134 or second dampers 135 disposed is not limited to six and may be more than or less than six. Also, the number of first dampers 134 disposed and the number of second dampers 135 disposed may be different.

Each first damper 134 includes the two main bent portions, 134*a* and 134*b*, and is in the shape of N or inverted N in a side view. However, the number of main bent portions of each first damper 134 is not limited to two and may be, for example, one, or three or more. The first dampers 134 are formed so as to be bent at least in the direction in which the vibrator 110 moves in the up-down direction, or advances and retreats, and the inner angles of the main bent portions are changed in accordance with movement in the up-down direction or advance/retreat of the vibrator 110. Thus, the vibrator 110 smoothly and actively moves in the up-down direction or advances and retreats with respect to the frame 120.

Since the first dampers 134 are bent in the direction in which the vibrator 110 moves in the up-down direction or advances and retreats, the horizontal length of the first dampers 134 from the vibrator 110 to the frame 120 is reduced compared to those of the conventional exciters. This facilitates a reduction in the outer diameter width of the exciter 100 and thus downsizing of the exciter 100. Also, even if the horizontal length of the first dampers 134 from the vibrator 110 to the frame 120 is reduced, the first dampers 134 are bent in the direction in which the vibrator 110 moves in the up-down direction or advances and retreats and thus the first dampers 134 obtain a sufficient extension/contraction length and thus sufficient damper performance.

Since the first dampers 134 are bent in the direction in which the vibrator 110 moves in the up-down direction or advances and retreats, the height size of the first dampers 134 is reduced and a sufficient vibration width of the vibrator 110 with respect to the frame 120 is obtained. Thus, the height size of the frame 120, vibrator 110, or the other components of the exciter is reduced, and downsizing of the exciter is facilitated.

The vibration generation apparatus according to the present invention is not necessarily limited to the configuration in which the vibrator moves in the up-down direction with respect to the frame. For example, even if the vibration generation apparatus is rotated by 90° and the vibrator advances and retreats horizontally with respect to the frame, as shown in FIG. 7, advantageous effects similar to those of the exciter (vibration generation apparatus) 100 according to the embodiment are produced. Accordingly, the configuration in which the vibrator horizontally advances and retreats with respect to the frame is also included in the right scope of the vibration generation apparatus according to the present invention as long as it corresponds to the invention-specific matters of the vibration generation apparatus according to the present invention.

What is claimed is:

1. A vibration generation apparatus comprising:

a concave frame having an opening in an upper portion thereof;

a vibrator housed in the frame; and first dampers each connected to the vibrator and the frame and configured to hold the vibrator such that the vibrator is able to move in an up-down direction with respect to the frame, each of the first dampers having a predetermined thickness, having an N-shape in a side view, comprising upper and lower two bent portions whose inner angles are changed in conjunction with each other when the vibrator moves in the up-down direction with respect to the frame, and having an upper end mounted on an edge of the opening and a lower end mounted on a lower edge of the vibrator, wherein the vibrator is housed in the frame such that a central axis in an up-down movement direction of the vibrator is coaxial with a central axis in the up-down movement direction of the frame, and the first dampers connected to the edge of the opening and the lower edge of the vibrator are discretely disposed so as to be equally distanced from the adjacent other first dampers and so as to be equally distanced from the central axes.

2. A vibration generation apparatus comprising:

a concave frame having an opening in an upper portion thereof;

a vibrator housed in the frame;

a first damper connected to the vibrator and the frame and configured to hold the vibrator such that the vibrator is able to move in an up-down direction with respect to the frame, the first damper having a predetermined thickness, having an N-shape in a side view, comprising upper and lower two bent portions whose inner angles are changed in conjunction with each other when the vibrator moves in the up-down direction with respect to the frame, and having an upper end mounted on an edge of the opening and a lower end mounted on a lower edge of the vibrator;

a voice coil bobbin having a first end provided with a voice coil and a second end fixed to an inner bottom of the frame; and a second damper having a predetermined thickness, having a first end mounted on a side surface of the voice coil bobbin and a second end mounted on the lower edge of the vibrator, and having a U-shape in a side view.

3. The vibration generation apparatus according to claim 2, wherein the voice coil bobbin is fixed to the frame such that the central axis of the vibrator and a central axis of the voice coil bobbin are coaxial, the second damper comprises a plurality of second dampers, and the second dampers are discretely disposed so as to be equally distanced from the adjacent other second dampers and so as to be equally distanced from the central axes.

4. The vibration generation apparatus according to claim 2, wherein at least one of the first damper and the second damper is formed of a resin material.

* * * * *